United States Patent [19]

Torii

[11] 4,098,420

[45] Jul. 4, 1978

[54] CAP FOR A BOTTLE

[75] Inventor: Eitoku Torii, Ibaragi, Japan

[73] Assignee: Daiwa Can Company, Ltd., Tokyo, Japan

[21] Appl. No.: 749,295

[22] Filed: Dec. 10, 1976

[30] Foreign Application Priority Data

Dec. 16, 1975 [JP] Japan ..... 50-169789[U]

[51] Int. Cl.[2] ..... B65D 41/42

[52] U.S. Cl. ..... 215/253; 215/262

[58] Field of Search ..... 215/250, 253, 254, 255, 215/262

[56] References Cited

U.S. PATENT DOCUMENTS

| | | | |
|---|---|---|---|
| 2,162,182 | 6/1939 | Smith | 215/254 |
| 3,130,056 | 4/1964 | Taylor | 215/254 X |
| 3,163,308 | 12/1964 | Friedell | 215/254 |
| 3,200,982 | 8/1965 | Cormier | 215/253 |
| 3,371,812 | 3/1968 | Foster | 215/253 |
| 3,421,681 | 1/1969 | Frank | 215/254 X |
| 3,446,383 | 5/1969 | Hannon | 215/253 |
| 3,782,576 | 1/1974 | Jacquemijns | 215/253 |
| 3,985,255 | 10/1976 | Blair | 215/254 |

*Primary Examiner*—Donald F. Norton
*Attorney, Agent, or Firm*—Watson, Leavenworth, Kelton & Taggart

[57] ABSTRACT

A cap for a bottle, having a top wall provided with an annular projected part, a skirt portion suspending downward from the peripheral edge of the top wall, a tab suspending downward from a part of the lower edge of the skirt portion, a pair of first separating lines extending toward the top wall from the vicinity of the intersection of the peripheral edge of the tap and the lower edge of the skirt portion, and a pair of second separating lines extending to the vicinity of the upper end of the skirt portion from the lower edge thereof, wherein the distance between the upper ends of the first separating lines is designed such that the terminal ends of the tearing of the first separating lines themselves, or of the tearing effected beyond the lines, are positioned on the tangent line of the internal peripheral circle of the annular projected part.

4 Claims, 9 Drawing Figures

CAP FOR A BOTTLE

DETAILED DESCRIPTION OF THE INVENTION

This invention relates to a cap made of a thin metallic sheet and adapted for use on a bottle such that a part of the cap fixed to a mouth of the bottle is torn so as to interconnect the atmosphere inside the bottle with that outside the bottle and thereby release the negative pressure inside the bottle, and thereafter the whole cap is removed from the bottle. This negative pressure as those skilled in the art well know is generated by the contents in the bottle.

One example of a bottle of this kind is disclosed in a Japanese patent gazette, in an application laid open for public inspection on Dec. 4, 1972 under publication No. 38275/72, wherein its cap consists of a top wall 105 and a skirt portion 106 suspending therefrom as shown in FIG. 1(*a*) and FIG. 1(*b*) (the U.S. counterpart of said application being U.S. Pat. No. 3,782,576). In said skirt portion, there are provided four separating lines 101, 102, 103 and 104 ascending substantially vertically from its lowermost edge 108. The separating line herein used may include a score line which is weakened so as to be easily cut, and a cut line which has already been cut. A seal member not shown is provided annularly in the internal side of the circumference of the top wall. Of the four separating lines, two lines 103 and 104 are placed opposite in a diameter of the cap, while the remaining two lines 101 and 102 are placed with a relatively small distance therebetween in about a center between said lines 103 and 104. In order to interconnect the atmosphere outside the bottle with that inside the bottle when a part of the skirt existing between the line 101 and the line 102 is lifted, there is provided a projected or recessed stripe 107 between said two lines in the peripheral part of the top wall which extends from the skirt side to the center side of the cap.

After this cap is caused to cover the mouth of the bottle, the lower portion of said skirt portion is bent inwardly toward the center of the cap so that it is engaged with the lower end of the outwardly expanded portion of the mouth of the bottle and fixed thereto. When it is desired to remove this cap from the bottle, the narrow bent part of the skirt portion between the two lines 101 and 102 is first stretched out so as to release it from engagement with said expanded portion of the mouth of the bottle. Then the skirt portion between the lines 101 and 102 is lifted up by grasping said stretched part whereby the negative pressure inside the bottle can be released by interconnection of atmosphere inside the bottle with that outside the bottle by virtue of said projected or recessed stripe 107 with or without its deformation. Thus the negative pressure by which the cap is pulled to the bottle is released and thereafter the skirt portion grasped as above is further lifted up. As a result, the engagement of the skirt portion with the expanded portion of the bottle in the parts between the lines 101 and 103 and between the lines 102 and 104 is released while the line 103 and the line 104 are torn respectively, whereby the cap and bottle eventually become out of engagement over a range of ½ of the circumference of the mouth of the bottle.

Thereafter, the remaining half engagement between the periphery of the bottle and that of the cap can be released by pushing the cap outwardly from the diameter line of the bottle, so that the cap will be completely detached from the mouth of the bottle.

However, this type of cap has a disadvantage that it has a projected or recessed stripe 107 extending from the skirt side 106 to the center side which results in incomplete seal of the bottle.

It is therefore an object of the invention to overcome the above disadvantage.

It is another object of the invention to provide a cap wherein the negative pressure inside the bottle can be released by lifting a part of the cap from the lower edge of the skirt.

This invention is directed to a cap made of a thin metallic sheet and capable of being torn which is adapted for use for a bottle subjected to negative pressure inside. The cap of this invention has a top wall provided with an annular projected part for receiving a sealing member inside the peripheral edge thereof; a skirt portion suspending downward from the peripheral edge of said top wall; and a tab member further suspending downward from a part of the lower edge of said skirt portion. There are also provided a pair of first separating lines extending toward said top wall from the vicinity of the intersection of the peripheral edge of said tab member and the lower edge of said skirt portion; and a pair of second separating lines extending to the vicinity of the upper end of said skirt portion from the lower edge thereof. The pair of second separating lines are arranged opposite to each other in a diameter line and apart with equal distance from the first separating lines respectively.

The distance between the upper ends of said first separating lines is of a size defined such that each terminal end of the tearing conducted along or beyond said separating lines is substantially positioned on a tangent line of an internal peripheral circle on the center side of the top wall of said annular projected part.

FIG. 1(*b*) is a plan view of FIG. 1(*a*).

Figure 1:
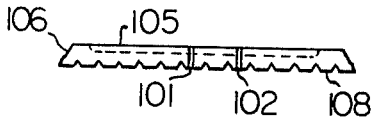
Fig. 1 (a) PRIOR ART
FIG. 1(*a*) is a side view of an example of the conventional cap used for releasing the negative pressure inside a bottle.
Figure 1:
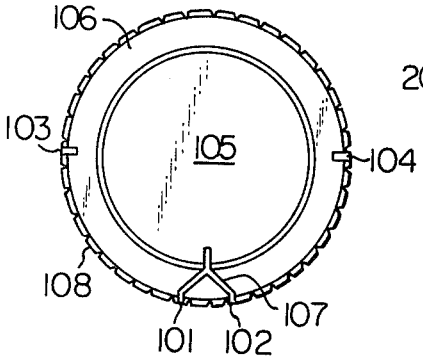
Fig. 1 (b) PRIOR ART
Figure 2:
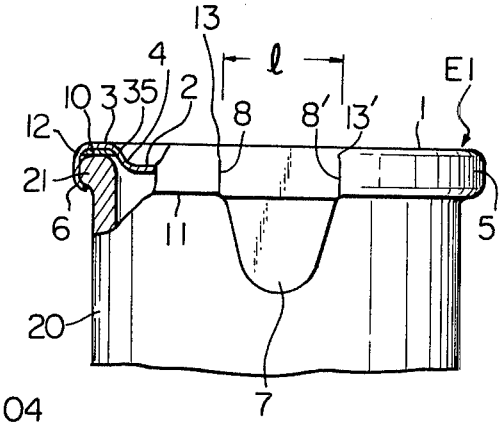
FIG. 2 is a front view partly broken illustrating one example of the cap of this invention mounted to the mouth of a bottle.
Figure 3:
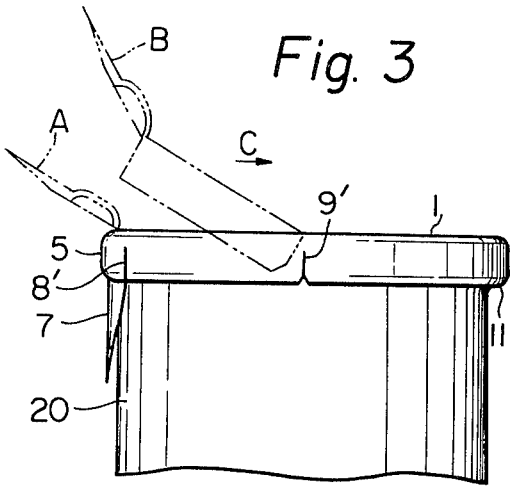
FIG. 3 is a right side view of FIG. 2 including a supposed line indicating removal of the cap of FIG. 2.
Figure 4:
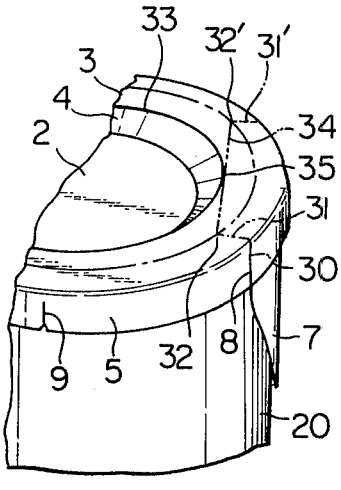
FIG. 4 is a partial perspective view seeing from the left of the cap of FIG. 2.
Figure 5:
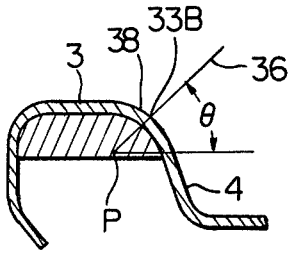
FIG. 5 is an explanatory view of the position of the internal peripheral circle on the annular projected part of the top wall.

In FIGS. 2 to 5 is shown a cap E1 made of a thin metallic sheet capable of being torn, in which the numeral 1 is its top wall; 2 is a central circular flat portion of the top wall; 3 is an annular projected part on the peripheral portion of the top wall; 10 is a sealing member applied to the inner surface of said projected part; 4 is a slope connecting the flat portion 2 with the projected part 3; 5 is a skirt portion suspending downward from the peripheral edge of the top wall; 6 is a portion bent toward the center of the cap and engaged with the lower end of the outwardly expanded portion 21 of the mouth of a bottle 20; 7 is a tab suspending downward from the lower edge 11 of the skirt portion 5 at an appropriate position thereof; 8 and 8' are a pair of first separating lines or score lines which extend upwardly and vertically toward the top wall from the vicinity of the intersection of the peripheral edge of the tab 7 and the lower edge 11 of the skirt portion and which reach the vicinity of an arc portion 12 connecting the skirt portion 5 and the annular projected part 3; and 9 and 9' are a pair of second separating lines or score lines which are positioned symmetrically with respect to the center of the top wall and apart with substantially same distance from the lines 8 and 8', respectively and which extend upwardly and vertically from the lower edge 11 of the skirt portion with substantially the same length as that of 8 or 8'. In FIG. 4, the numeral 33 indicates an internal peripheral circle inside the projected part 3, which circle is given, as shown in FIG. 5, by connecting points 33B. These points 33B are intersections of an arc portion 38 connecting the projected part 3 and the slope 4 with oblique lines 36 extending at an angle of $\theta = 45°$ with respect to said projected part from the center P of said arc portion.

When it is desired to remove a cap E1 from the mouth of the bottle 20 on which it has been mounted, the tab 7 is lifted so as to tear the skirt portion along the pair of first separating or score lines 8, 8'. When the tab is further lifted, the break proceeds substantially on the extensions 30 of the lines 8, 8', whereby the skirt portion is torn up to the upper end thereof, and when the tab is furthermore lifted, the break proceeds on the extensions 31, 31' of the llines 8, 8' as shown in FIG. 4. If the distance *l* between the upper ends 13 and 13' of said lines 8 and 8' is preliminarily designed so that said terminal ends 32, 32' of the tearing are positioned on a tangent line 34 of the internal peripheral circle 33, a line connecting the points 32 and 32' becomes naturally coincident with said tangent line 34. When the line connecting these terminal ends 32 and 32' becomes coincident with such tangent line 34 of the internal peripheral circle in the above way, it is no longer possible for the whole part between the tearing lines 31, 31 made beyond possible for the whole part between the tearing lines 31, 31' made beyond the upper ends of the separating lines 8, 8' to further proceed, which results in halting of the tearing. It is because (1) there is the slope 4 between the projected part 3 and the flat portion 2; (2) the middle point 35 between the tearing lines 31 and 31', coinciding with the contact point of the tangent line 34 with the internal peripheral circle 33, is positioned near said slope 4; (3) said middle point 35 thus tends to go down along the slope 4; (4) while the terminal points 32, 32' of the tearing still remain on the flat surface of the projected part 3 and tend to keep on proceeding thereon. At the time that the tearing stops proceeding as above, the approximate position of the tab is shown as A in FIG. 3. If, at this time, the terminal points 32, 32' of the tearing parts 31, 31' are designed to be positioned in about the middle of the radial width of the projected part 3, the aforesaid proceeding of the tearing will accurately stop and the initial power required to lift up the tab can also be kept to a relatively small level with a desirable result. When, however, the width of the annular projected part is greater, the distance between the lines 8 and 8' may be designed such that the terminal points approach nearer the side of the internal peripheral circle 33 than the middle position of the radial width of the projected along lines 3. In any case, all that is necessary is that the proceeding of the tearing parts 31, 31' can stop within the annular projected part.

The tearing so far described can be done with a relatively small power since it is not affected by the negative pressure inside the bottle and it is thus a simple tearing of the cap material. If the tearing proceeds to the above degree and yet the negative pressure does exist inside the bottle, the removal of the cap which must be done from this stage will require a considerably large power, since it must not only overcome the negative pressure inside the bottle but also release engagement of the cap with the bottle. However, as shown in this embodiment, if the tab bends at the position of the tangent line 34, the atmosphere is interconnected with the inside of the bottle in the vicinity of the point 35 as shown in FIG. 2 so that the negative pressure inside the bottle can be released and accordingly the force by which the cap has been pulled toward the mouth of the bottle can also be released. As a result, the only thing that need be done is to release the engagement of the bottle with the lower part of the skirt.

Thus, when the tab 7 continues to be lifted, the tearing does not proceed any longer but the engagement of the bent portions 6 between the lines 8 and 9 and between the lines 8' and 9' respectively with the expanded portion 21 is gradually released from the location of the first separating lines toward the second separating lines. At the same time the tearing along the second separating lines 9, 9' begins to proceed. At this stage the condition of the tab 7 is shown as B in FIG. 3, and the whole cap can be easily removed from the mouth of the bottle only by pushing the cap in the direction of the arrow C in FIG. 3.

In the embodiment described above, the cap E1 is made of an aluminium sheet having the thickness of 0.2 mm; the diameter of the internal peripheral circle of the annular projected part is about 36 mm; the distance between the first separating lines is 18 mm; and the outside diameter of the mouth of the bottle is about 46 mm. The maximum stress in the first tearing, that is, one caused until it reaches to the position of 32, 32' is about 2 kg, and the maximum stress in the second tearing, that is, one caused until the tab 7 reaches to the condition of B in FIG. 3 by breaking the second separating lines 9, 9' is about 2.5 kg.

Figure 6:
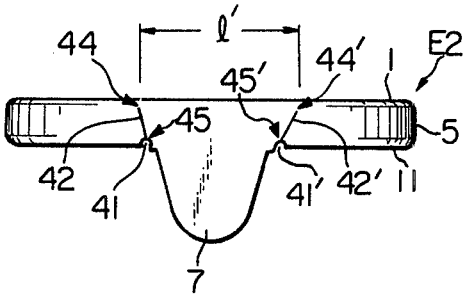
FIG. 6 is a front view illustrating another example of this invention.

In the above description, the separating lines are made by the score lines 8, 8' and 9, 9', but they may all be cut lines or a combination of both. A cap E2 as shown in FIG. 6 is the second embodiment of the invention, which is different from the one shown in FIG. 2 in that it has small notches 41, 41' in the lower edge 11 of the skirt portion 5 on both side of the tab 7 and that the first separating or score lines 42, 42' are widened upwardly, starting from the notches 41, 41' toward the top wall side. In this embodiment, if the distance *l'* between the upper ends 44 and 44' of the first separating lines 42 and 42' is equal to the distance *l* between the upper ends 13 and 13' of the first separating lines 8 and 8' in FIG. 2, the position where the tearing stops in the annular projected part 3 is substantially equal to the case of FIG. 2. In this case, however, the distance between the lower points 45 and 45' of the first separating lines 42 and 42' is naturally made narrower than the case of FIG. 2. Accordingly, the power to release the engagement of the mouth of the bottle with the lower end 11 of the skirt portion between the lines 42 and 42' by pulling up the tab 7 can be made smaller. It is thus particularly effective in case that the diameter of the bottle or the cap is large.

Figure 7:
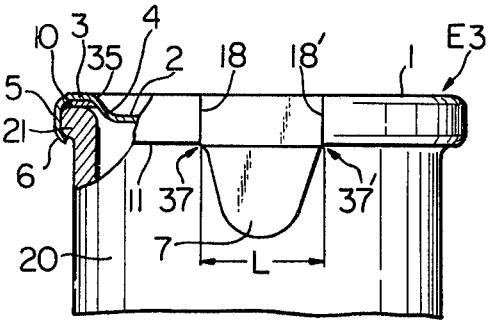
FIG. 7 is a front view, partly broken, illustrating still another example of this invention similar to that of FIG. 2.
Figure 8:
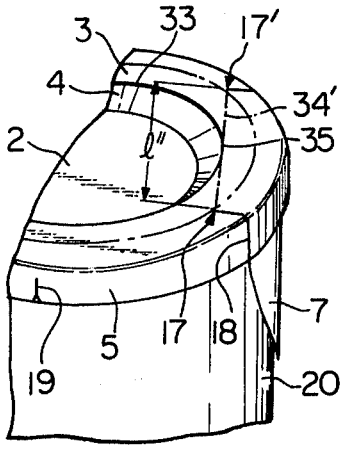
FIG. 8 is a partial perspective view seeing from the left of the cap of FIG. 7.

In FIGS. 7 and 8 is shown still another embodiment of this invention. FIGS. 7 and 8 are similar to FIGS. 2 and 4, respectively, the same reference numerals indicating the same parts.

The point in which the cap of this embodiment differs from that of FIGS. 2 and 4 is that the first separating lines 18 and 18' extend out in the annular projected part 3 of the top wall 1 of the cap E3 and that the upper ends thereof 17, 17' are already positioned on the tangent line 34' of the internal peripheral circle 33 on the center side of the top wall of said projected part 3. Consequently, it is obvious that the distance *l''* between the upper ends 17 and 17' of the first separating lines 18 and 18' is designed such that when the separating lines are torn, the terminal ends of the tearing lie on the tangent line 34' of said internal peripheral circle. Since the lines 18, 18' run parallel with each other, the distance *l''* between the upper ends 17, 17' is equal to the distance L between the starting ends 37, 37' of said separating lines. In the cap of this embodiment, the first separating lines themselves are made up to the terminal ends of the first tearing, that is, up to 17, 17'. Therefore, the tearing can be done more easily than in the case of FIGS. 2 and 6. In the structure as shown in FIGS. 2 and 6 wherein the first separating lines are short so that the tearing must be continued on the area where the separating lines no longer exist after the tearing of the separating lines themselves is over, it sometimes happens, though rare, that a part departing from the extension of the separating lines is torn depending upon the particular material of the cap used. When such material has to be used, the structure as shown in FIG. 8 is very suitable. The above mentioned upper ends 17, 17' do not have to lie accurately on said tangent line 34', and can be positioned in the vicinity thereof. In this embodiment, the cap E3 is made of an aluminium sheet having the thickness of 0.22 mm; the diameter of the internal peripheral circle of the projected part is about 36 mm; the distance between the first separating lines is 18 mm; and the outside diameter of the mouth of the bottle is about 46 mm. The maximum stress in the first tearing is about 1.8 kg, while the maximum tearing in the second tearing, where the second lines 9, 9' are broken and the tab 7 is brought to the condition shown as B of FIG. 3, is 2.5 kg.

The cap of this invention has such effects and advantages that since it has no projected nor recessed stripe on the annular projected part of its top wall, the sealing of a bottle can be done accurately; that since the distance between the upper ends of the first separating lines is designed such that the terminal ends of the tearing of the first separating lines themselves, or of the tearing effected beyond said first separating lines, are positioned on the tangent line of the internal peripheral circle of said annular projected part, the tearing can accurately stop within the annular projected part and release the negative pressure inside the bottle when it stops; and that owing to the release of the negtive pressure the following operation for removing the cap is made very easy.

I claim:

1. In a cap made of a thin metallic sheet capable of being torn and adapted for use on a bottle in which a negative pressure is generated by the contents, said cap having (a) a top wall provided with a central circular flat portion, an annular raised portion for receiving a sealing member, and a sloping wall portion connecting said central circular flat portion with said annular raised portion; (b) a skirt portion depending downward from the outer peripheral edge of said raised portion; and (c) a tab member depending downward from a part of the lower edge of said skirt portion; said cap further having (d) a pair of first separating lines extending toward said top wall from the vicinity of the intersection of the peripheral edge of said tab member and the lower edge of said skirt portion; and (e) a pair of second separating lines extending to the vicinity of the upper end of said skirt portion from the lower edge thereof; said second separating lines being arranged diametrically opposite each other with respect to said top wall and spaced respectively equally distant from said first separating lines; the improvement wherein the character of said thin metallic sheet is selected such that in the absence of said separating lines it is nevertheless readily tearable by manual lifting of said tab member, and the spacing between and respective orientation of said first separating lines are chosen relative to the dimensions of said cap such that grasping and manually lifting said tab member produces tear lines coinciding at least at their beginning with said first separating lines and terminating at points in said raised portion of said top wall on an imaginary line tangent to the circle at the top of said sloping wall portion, the distance between such points being such that the resistance imposed by said points is sufficient to interrupt further tearing of said top wall along projections of said tear lines whereby further lifting of said tab member causes separation of said second separating lines and folding back of half of said cap along the line joining said second separating lines.

2. The cap as claimed in claim 1 wherein the first separating lines extend to the upper end of the skirt portion.

3. The cap as claimed in claim 2 wherein the first separating lines widen upwardly divergently toward the upper end of the skirt portion.

4. The cap as claimed in claim 1 wherein the first separating lines extend inwardly in the annular raised portion.

* * * * *

UNITED STATES PATENT AND TRADEMARK OFFICE

CERTIFICATE OF CORRECTION

PATENT NO. : 4,098,420

DATED : July 4, 1978

INVENTOR(S) : Eitoku Torii

It is certified that error appears in the above-identified patent and that said Letters Patent are hereby corrected as shown below:

In the Abstract, line 7 thereof, "the tap" should read --the tab--.

At Col. 3, line 43, "lines 31, 31" should read --31, 31'--.

At Col. 4, line 1, "projected along lines 3." should read --projected part 3.--.

At Col. 4, line 2, "tearing parts" should read --tearing along lines--.

Signed and Sealed this

*Second* Day of *January 1979*

[SEAL]

*Attest:*

RUTH C. MASON
*Attesting Officer*

DONALD W. BANNER
*Commissioner of Patents and Trademarks*